US005157802A

United States Patent [19]

Guidry et al.

[11] Patent Number: 5,157,802

[45] Date of Patent: Oct. 27, 1992

[54] PIPE THREAD CLEANING APPARATUS

[76] Inventors: Mark L. Guidry, 410 Steeplechase Dr., Lafayette, La. 70506; Douglas J. Guidry, 203 Lormand Rd., Scott, La. 70583

[21] Appl. No.: 779,866

[22] Filed: Oct. 21, 1991

[51] Int. Cl.[5] ..... B08B 9/02

[52] U.S. Cl. ..... 15/88; 15/104.04; 15/104.05; 15/104.095

[58] Field of Search ..... 15/88, 104.04, 104.05, 15/104.1 R, 104.03

[56] References Cited

U.S. PATENT DOCUMENTS

| | | | |
|---|---|---|---|
| 3,436,783 | 4/1969 | McCartney | 15/104.04 |
| 4,011,617 | 3/1977 | Toelke et al. | 15/88 |
| 4,014,062 | 3/1977 | Scott et al. | 15/104.04 |
| 4,403,363 | 9/1983 | Hess | 15/88 |
| 4,433,448 | 2/1984 | True | 15/104.04 |

*Primary Examiner*—Edward L. Roberts
*Attorney, Agent, or Firm*—John D. Jeter

[57] ABSTRACT

A pipe thread cleaner has cleaning heads with rotated thread brushes driven by motors on the heads. Separate heads for box and pin ends have splash shrouds with gaskets to bear on pipe surfaces. Cleaning fluids under pressure are supplied, selectively, to the heads. The heads have a scavenger system plumbed to a vacuum collector tank. The heads have pipe bore plugs on brush spindle extensions that seal the bore and squeegee the inner pipe surfaces when the heads are removed from the pipe. Optionally, compressed air replaces cleaning fluid to jets in the heads to finally blow dry the cleaned threads. Further options include jets that spin with the brushes and a centrifuge to recover reusable cleaning fluids from the effluent fluids from the cleaning heads.

20 Claims, 3 Drawing Sheets

PIPE THREAD CLEANING APPARATUS

This invention pertains to apparatus for cleaning the threads on pipe ends on petroleum drilling, and production related sites. Included are equipments to process and recover cleaning fluids, solvents, and debris involved for environmental protection.

BACKGROUND

Petroleum related activities are well known for imposing upon the environment assorted processing and production fluids quite harmful to the natural setting.

Drilling and production tubular goods are normally supplied in sections of about thirty foot length. Entire well strings are made up of such sections. In drilling, the well string is frequently tripped and stands usually of ninety to one hundred twenty feet are commonly stored temporarily in a vertical array extending up into the rig tower. Each stand is supported on the tool joint end and the threads cannot be serviced until the stand is picked up. The top threads are usually serviced when the stand is joined to the string and that thread is then the top end of the suspended string. While the string is idle the threads still are coated with tacky thread grease from the previous cleaning and lubricating cycle. Debris collects on the threads.

Traditional thread cleaning has involved a bucket and brush. The usual rig floor worker is rarely short of good intentions but haste is ever present. The threads in tool joint boxes and mating pins degrade and require occasional rework at prepared facilities. Pipe handling, transport, and rework is a serious expense.

Production tubing is tripped less often but that extends time between thread inspections. A single leaky thread can stop production and necessitate well workover and pipe rework. The costs are still a serious matter.

Under pressure of government regulatory agencies and conscientious producers various efforts to mechanize the thread servicing function has resulted in various useful sub-systems being used on sight. This is often a collection of separate useful devices requiring coordination to avoid spillage of contaminants.

There is a need for a composite system for handling solvents and other cleaners, the cleaning mechanism and the recovery of fluids and debris. The composite system needs to be efficiently usable wherever pipe threads are cleaned whether pipe is vertical or horizontal. At well sites the pipe is usually at hand both vertical and horizontal.

It is therefore an object of this invention to provide apparatus that can service threads on box or pin ends of pipe in both the vertical and the horizontal position.

It is another object of this invention to provide apparatus for pipe thread cleaning with shrouds that sealingly engage pipe surfaces to prevent spillage of cleaning fluids and debris while cleaning proceeds.

It is yet another object of this invention to provide pipe thread cleaning apparatus with movable thread cleaning heads flexibly connected to a cleaning fluid source under pressure and a waste fluid storage reservoir under vacuum.

It is a further object of this invention to provide apparatus to apply power to rotate thread cleaning brushes in cleaning heads and to supply cleaning fluids and purge air to clean and dry threads.

It is still another object of this invention to provide squeegee gaskets for both outer and bore surfaces of pipe to be serviced that is attached to cleaning heads and activated by the act of installing the cleaning heads on pipe.

It is yet another object of this invention to provide automatic sequencing gear to automatically sequence the cleaning functions when the cleaning action is initiated manually.

It is further another object of this invention to provide a centrifuge to process the effluent fluids to remove the portion of those fluids capable of further use as cleaning fluids.

These and other objects advantages, and features of this invention will be apparent to those skilled in the art from a consideration of this specification, including the attached claims and appended drawings.

SUMMARY OF THE INVENTION

A source of pressurized cleaning fluid is flexibly connected and selectably valved to a pin thread cleaning head and a box thread cleaning head. Both heads have rotating cleaning brushes driven by motors on the heads driven, preferably, by rig air. A vacuum scavenger tank is selectably valved and flexibly connected to the heads. The scavenger tank is ullage pumped by a vacuum pump exhausting to the atmosphere. The cleaning fluid is jetted against the threads being cleaned, optionally, by jets connected by a swivel to the source plumbing and mounted on the brushes. Each head has a shroud sealingly in contact with serviced pipe surfaces to prevent splash and spillage. Scavenger plumbing is connected to a low point in the shrouds to recover fluids and debris collected.

On each brush an extension supports a gasket that seals the serviced pipe bore and serves as a squeegee to swab the bore and related surfaces clean as the heads are removed from the pipe after cleaning actions. Additionally, the head shrouds have gaskets that serve as closures between surfaces of serviced pipe and the shroud and function as a squeegee to clean and dry the pipe outer surface as the head is withdrawn from the pipe. Optional features include plumbing and valving to replace the cleaning fluid stream with rig air to blow dry the cleaned surfaces of the pipe after brushes and cleaning fluid jets have served the cleaning function. Another option includes a bearingly supported mandrel on brush spindles to fit the pipe bore and support cleaning heads on horizontal pipe.

Another optional feature includes a timer and sequencing system to provide an interval of cleaning fluid application followed by an interval of air purging through the jets followed by brush drive motor shutdown and finally scavenger shutdown.

Further optional features include cleaning- fluid jets that spin with the brushes and a centrifuge to receive effluent fluids from the heads, process the fluid to remove the reusable cleaning fluid, and inject it into the cleaning fluid tank.

BRIEF DESCRIPTION OF DRAWINGS

In the drawings wherein like features have similar captions, FIG. 1, partly cut away and partly schematic, shows the overall apparatus of the invention.

DETAILED DESCRIPTION OF DRAWINGS

Figure 1:
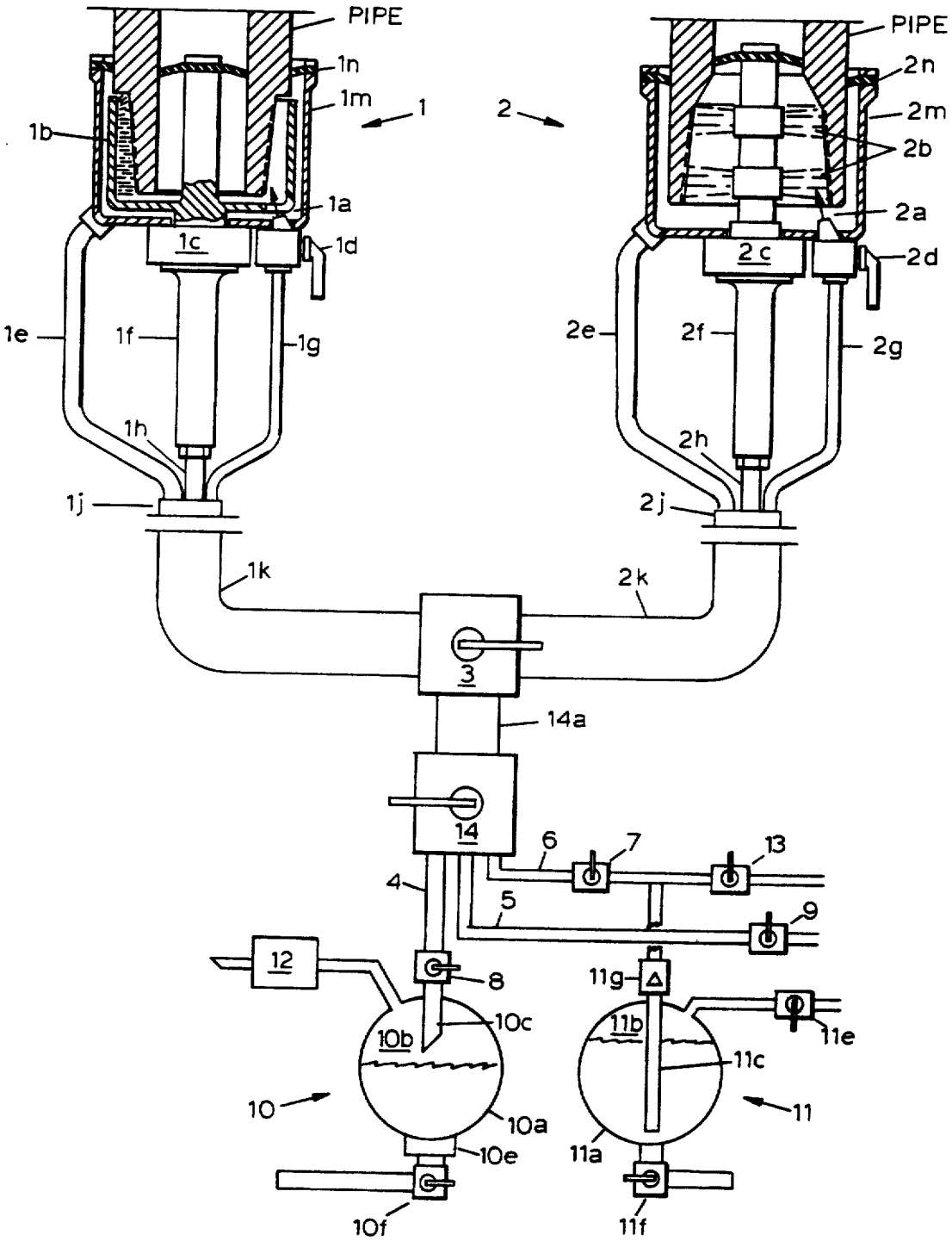

In the drawings various details of manufacturing and maintenance utility are omitted, in the interest of descriptive efficiency and clarity, unless the details pertain to points of novelty. Threaded fasteners, pipe threads and most plumbing details are in the art and well established and, hence, not shown. Plumbing handling fast moving fluids require supports at points prone to deform under surge conditions but depend upon the configuration of the system used and such details are not shown. In field use, the overall apparatus disclosed is, preferably, assembled in a composite package suitable for single-load crane handling and compact disposition on well and platform sites. The descriptive drawings pertaining to function are best disposed about drawings for best use of captions and the drawings, therefore, do not represent preferred packaging locations which are not claimed matter.

FIG. 1 represents an overall system and pertinent details of some points of novelty are reserved for later figures. Head 1 is a light weight pin thread cleaning assembly connected by a flexible trunk line to sources of fluids and vacuum. Head 2 is a light weight box thread cleaning assembly similarly connected by a flexible trunk line to similar fluid sources and vacuum. Selector valve 3 is a gang valve, commonly available as single valves to be assembled for single shaft operation, Valve 3 is shown in more detail in FIG. 2. Valve 3 receives fluids and vacuum from on-off gang valve 14 and directs them to one of the heads and shuts off the other head. Valve 14 is optional and is preceded by service valves in each incoming line. From the open position valve 14, when moving, turns off cleaning fluid and brush drive air in one increment of motion and turns off vacuum with a further movement of the control. When opening, valve 14 first starts vacuum then air and cleaning fluid. Head 1 has splash shroud **1*m* that encloses the end of the pipe to be serviced with gasket seal 1*n* in contact with the pipe outer surface. The shroud supports air motor 1*c* the output shaft of which carries brush 1*b*, cleaning fluid valve 1*d*, jet 1*a*, manipulator handle 1*f*, vacuum tube 1*e*, cleaning fluid line 1*g* and air delivery line 1*h*. The vacuum, air, and cleaning fluid lines are collectively carried toward the common tanks and controls by flexible trunk line 1*j***.

Head 2 has a thread cleaning brush for internal threads of the box end of the serviced pipe and the jet **2*a* is positioned to spray internal threads and brush but is otherwise identical with head 1. Captions are identical except for the prefix 2 and the functions involved are identical to head 1**.

In pipe yards, the overall system may serve just one head, with a similar system serving the other end of massive stacks of pipe with the other head attached. In such cases the selector valve is omitted from both systems. On such as drilling sites, the system is used as shown with a selector valve activating the head needed at the time.

Selector valve 3 has extensions **1*k* and 2*k* for attachment to the flexible trunk lines and those extensions carry all three lines. Valve 14 is a gang valve assembly of shut-off form connected to valve 3 by trunk line 14*a*. From valve 14, line 4, with valve 8 and tube 10, vacuum is delivered from vacuum source 10. Line 5 is an air line, usually from rig air, by way of valve 9, for brush drive motors. Line 6 is a cleaning fluid line with shut-off valve 7 leading to cleaning fluid source 11. Check valve 11*g* and air shutoff valve 13 are optional and are used if air is used to blow dry threads and brushes after thread cleaning. This simple system depends upon the cleaning fluid pressure being regulated below the pressure of air available to valve 13. In that use, valve 13 is opened before valve 7 is shut off. Check valve 11*g* prevents the air from back-flowing into the cleaning fluid tank. An independent pump can be placed between check valve 11*g* and source line 11*c* if the tank 11*a* is not to be air pressurized. As shown, air is delivered by way of shut-off valve 11*e*, usually from a regulated source of rig air, through line 11*d* into the ullage region 11*b* of tank 11*a*. If the cleaning fluid needs stirring, the line 11*d* enters strategically near the tank bottom. Tank 11*a* has purge and drain valve 11*f*** opening into a sump region of the tank for draining and cleaning.

Vacuum pump 12 reduces the pressure in the ullage region **10*b* of tank 10*a* to avoid exhausting effluent and debris into the atmosphere. Pump 12 may be a mechanical pump or and pump or and eduction pump driven by rig air, a system often called an aspirator. Tank 10*a* has sump 10*e* and a shut-off valve 10*f* for periodic removal of effluent fluids, spent cleaning fluid, and debris by way of shut-off valve 10*f***.

Figure 2:
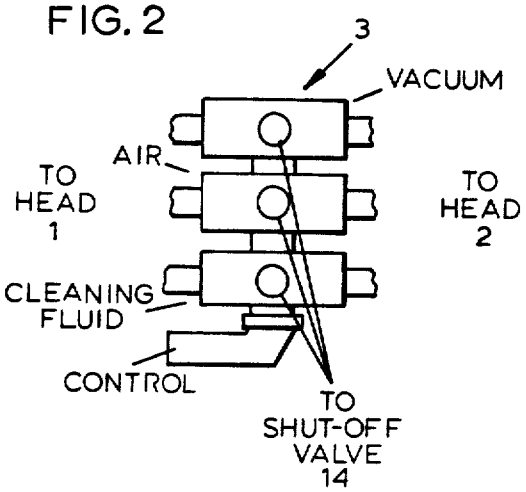
FIG. 2 is a simplified elevation showing a particular assembly for the apparatus of FIG. 1.

FIG. 2 discloses the preferred embodiment of the selector gang valve 3 of FIG. 1. Such valves are individually available for assembly on one control shaft to form a composite package responsive to the single control. This valve by control selectivity, directs vacuum, air and cleaning fluid from the individual sources to the trunk lines to the preferred head.

Figure 3:
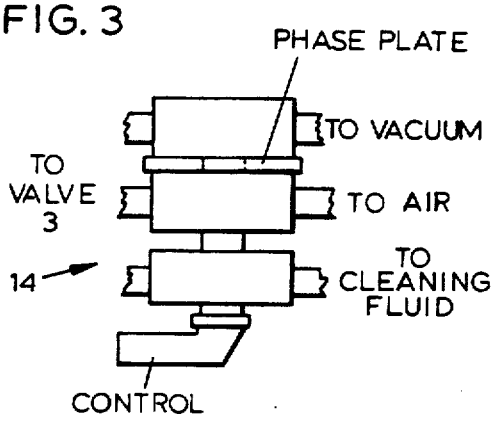
FIG. 3 is a simplified elevation of another particular assembly for the apparatus of FIG. 1.

FIG. 3 shows a gang-type shut-off valve 14 similar to the selector valve in configuration and it is available from the same supply houses. It is preferred to rotationally misalign the vacuum valve such that it opens first and closes last relative to the air and cleaning fluid valves. It is best to have vacuum scavenging in operation before the onset of fluid flow and after the cessation of fluid flow to the heads. Available gang valves are commonly drilled for mounting such that a single cap screw through the holes mounts all valves and all valves are in phase. It is preferred to misphase the vacuum valve and a phase plate accepts cap screws from opposite sides so that valves on opposite sides can be rotationally misaligned to produce the desired operating relationship. The rotating elements are tang and groove connected and do not have to be modified.

Figure 4:
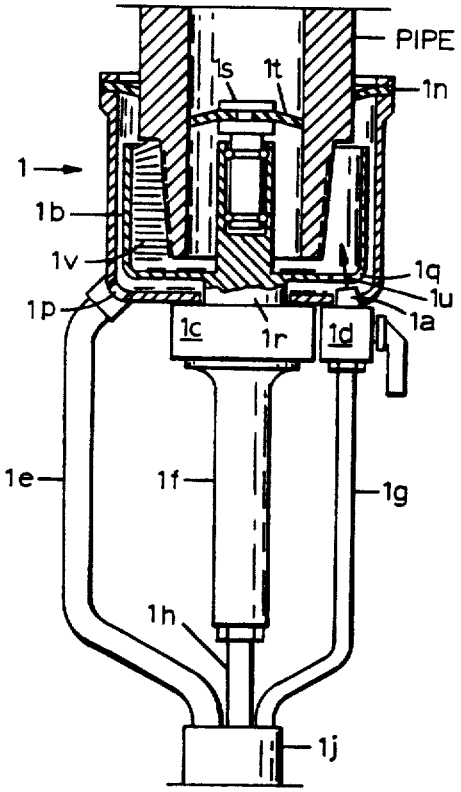
FIG. 4 is an elevation, partly cut away and somewhat enlarged, of one of the two cleaning heads for the apparatus of FIG. 1.

FIG. 4 shows head 1 in greater detail than FIG. 1 with some captions added. Captions through **1*n* have been explained. Brush 1b has spindle extension 1r which carries bearing mounted adapter 1s which, in turn, carries gasket 1t which engages the pipe bore wall to seal in splash and squeegee the bore dry when the head is removed from the pipe. Drain port 1p is placed on the low side of the head in whatever position the head is used. Brush bristles 1v are in distributed array with holes 1q peripherally distributed between arrays so that jets 1u can enter the brush cup to bear on threads and bristles. The alternate form of this head for cleaning internal threads is not shown because only the brush differs from that of this figure. On the internal thread brush 2b, a bearing mount for the bore seal gasket 1t** is similar to that shown here.

Figure 5:
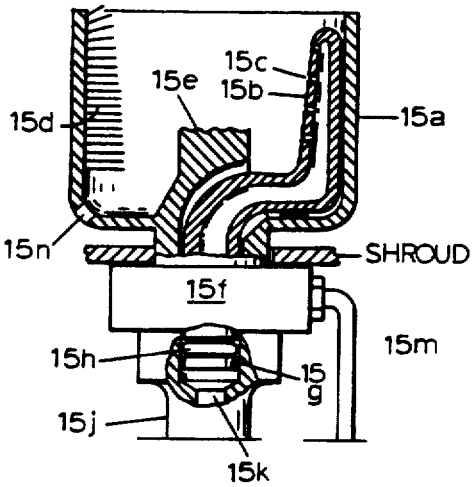
FIG. 5 is an elevation, mostly cutaway, and somewhat enlarged, showing an alternate brush and jet combination.

FIG. 5 shows an alternate form of the external thread cleaning head. Brush drive motor 15f has a hollow spindle that accepts jet assembly 15b which spins with brush 15a to spray fluid from jets 15c. The shroud is unchanged and is only partly shown. Spindle extension 15e is unchanged on the upper end and supports a bore seal gasket (not shown). Bristles 15d are set in arrays to leave space for at least one jet assembly 15b. Ports 15n drain fluid from the brush cup. Cleaning fluid enters handle 15j by way of bore 15k to enter the jet assembly arbor 15g, confined by seal 15h. The drive motor air is supplied through tube 15m. The head otherwise is identical to that of FIG. 4.

Figure 6:
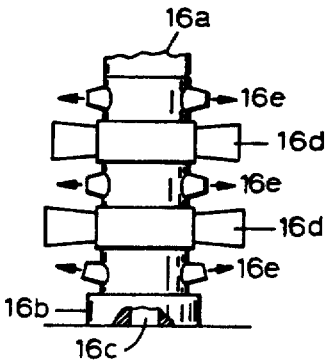
FIG. 6 is an elevation, mostly cut away, showing the internal thread cleaning brush and jet assembly that can directly replace the brush and jet assembly of FIG. 5.

FIG. 6 shows an assembly that directly replaces the assembly 15a of FIG. 5 for cleaning internal threads. Arbor 16b attaches to motor 15f and accepts fluid through bore 16c. Fluid flows to and through jets 16e and impacts on threads and on brushes 16d mounted on the arbor. Arbor extension 16a extends upward to support the usual bore seal (not shown).

Figure 7:
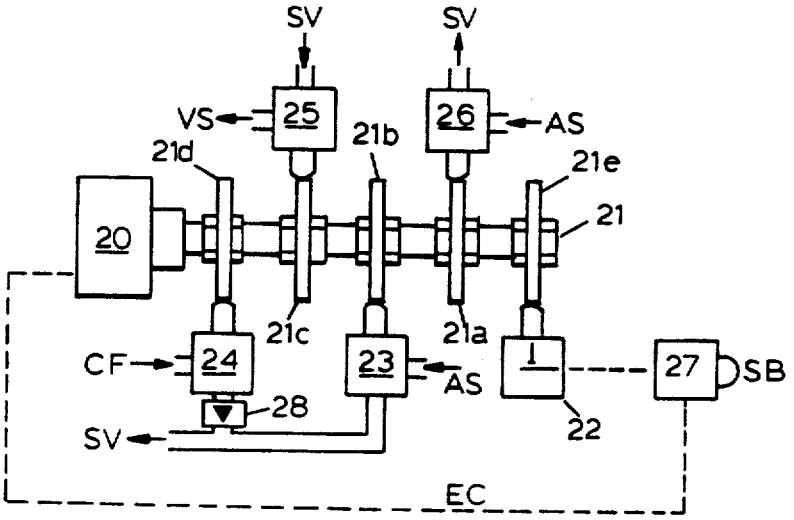
FIG. 7 is an elevation, partly schematic, showing a motorized sequencing assembly to control fluids and vacuum delivered to cleaning heads.

FIG. 7 shows an automatic sequencing system to serve the same function as the valve 14 of FIG. 1. Motor 20 drives cam spindle 21 which carries cams 21a, 21b, 21c, 21d and 21e. The cams actuate valves 26, 23, 25, 24, and switch 22 respectively. Switch 22 shuts off power to the motor when the cams make a complete revolution. To restart the sequence, switch 27 is closed manually by pushing button SB for a short interval during which the cams rotate and switch 22 closes to continue the motor operation until a complete turn of the cams occurs. Switch 27 is in parallel with switch 22. Preferably, the vacuum valve 25 is opened first to access vacuum source VS and is closed last. Valve 26 conntrols the brush drive motor and accesses the air supply AS and valve 24 accesses the cleaning fluid supply CF. Valves 24 and 26 may be opened simultaneously. It is preferable to run the brush drive motor until vacuum is cut off. Unless air pressure AS to valve 23 is higher than the cleaning fluid pressure, valve 24 is closed and valve 23 is opened. Then all but the vacuum valve and brush drive air valve are closed. Finally, the vacuum valve and valve 26 are closed and switch 22 opens to stop the sequence. Circuits to the selector valve are captioned SV. Check valve 28 prevents the flow of air into the cleaning fluid source. The cams are captured between hex nuts on the spindle and are axially and rotationally adjustable. The valves are supplied with cam follower rollers to engage the cams.

Figure 8:
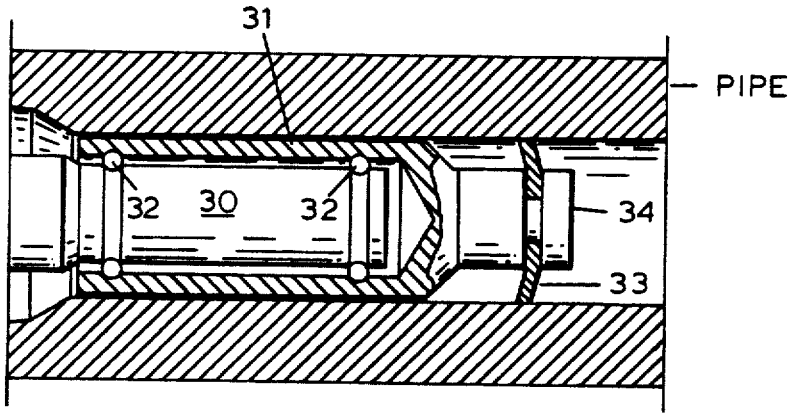
FIG. 8 is an elevation, mostly cut away, showing a brush spindle adaptation to centralize cleaning heads on pipe.

In FIG. 8, extension 30 is part of the brush spindle being used to support the seal, gasket in the pipe bore. In this option, a bearing supported mandrel 31, is carried on the extension by bearings 32 and is selected to fit the pipe bore, free to slide therein. Finally, seal gasket 33 is attached to the mandrel head 34 and functions in the bore as previously described.

Figure 9:
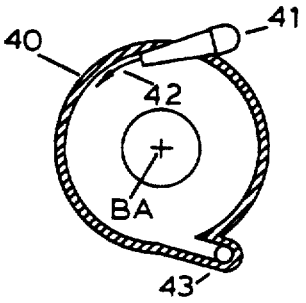
FIG. 9 is a section cut transversely through a head shroud to show an alternate shroud cleaning arrangement.

In FIG. 9 a shroud. 40, similar to those already described, is fitted with a jet 41 to carry cleaning fluid or air and projects a jet 42 to peripherally sweep the inner surface of the shroud. The sweep direction is logically in the same direction as brush rotation. For such a shroud the vacuum scavenging port 43 is angled to facilitate entry of peripherally moving fluids.

Figure 10:
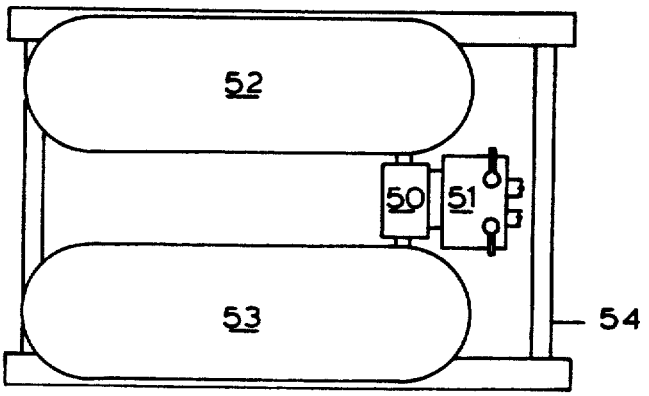
FIG. 10 is an elevation showing the usual arrangement of tanks and controls, with an optional centrifuge.

FIG. 10 shows the usual single load assembly of cleaning fluid tank 52 and vacuum tank 53 on skid frame 54. The pump and control package 51 contains the selector valve and shut-off valves previously described. Automatic sequencer gear, if used, is housed in this package. Not previously described is the optional centrifuge 50, used to recover the lighter fluids from the effluent collected in the vacuum tank. The recovered lighter fluids are mostly cleaning fluids and may be returned to the cleaning fluid tank for reuse.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof it is to be understood that all matter herein set forth or shown in the accompanying drawings is to be interpreted as illustrative and not in a limiting sense.

The invention having been described, we claim,

1. Thread cleaning apparatus for cleaning the threads on the end of tubular goods, positioned vertical or horizontal, at petroleum related sites, the apparatus comprising: at least one cleaning head to slip on the pipe end, a source of pressurized cleaning fluids, a vacuum induced scavenger system, flexible plumbing to deliver power, cleaning fluids and vacuum to each head and controls to regulate delivery of said power, fluids and vacuum to said head; said head comprising a shroud to contain fluids delivered to said head, at least one gasket to close openings between said head and pipe being cleaned, rotating brushes arranged to brush said threads, a motor arranged to rotate said brushes, fluid jets to deliver said cleaning fluid against said threads, and porting for attaching said vacuum; said cleaning fluid source to comprise a cleaning fluid tank and means to provide, pressure to move said cleaning fluid to said head, said vacuum system comprising an effluent confinement tank and means to propel effluent from said ports to said confinement tank, said controls to comprise at least one valve to shut off said cleaning fluid delivery to said head and at least one valve to shut off delivery of said vacuum to said head.

2. The apparatus of claim 1 wherein said cleaning fluid is directed at said threads from at least one jet attached to and rotating with said brush, said cleaning fluid being supplied from said source through a swivel attached to said head.

3. The apparatus of claim 1 wherein said brush is removably attached to an output shaft of a rotary motor attached to said head.

4. The apparatus of claim 3 wherein said motor is a compressed air driven motor.

5. The apparatus of claim 1 wherein compressed air is provided to a selector valve arranged to selectably replace said stream of cleaning fluid.

6. The apparatus of claim 1 wherein said controls include automatic sequencing to start said motor, start said stream of cleaning fluid, replace said stream of cleaning fluid with said compressed air, stop the flow of said compressed air, stop said motor and finally stop said vacuum.

7. The apparatus of claim 1 wherein said gasket comprises at least one deformable elastomeric element attached to said head and arranged to peripherally contact the external surface of said pipe for head to pipe closure and to function as a squeegee to remove liquids from said external surface when said head is withdrawn from said pipe.

8. The apparatus of claim 1 wherein said gasket comprises at least one elastomeric element attached to said brush and arranged to extend into the bore of said pipe to at least partially occlude said bore and to function as a squeegee to remove liquids from said bore when said head is withdrawn from said pipe.

9. The apparatus of claim 1 wherein said means to propel comprises a vacuum pump with intake in an ullage region of said confinement tank.

10. The apparatus of claim 9 wherein said vacuum pump is a compressed air jet eduction coupled pump.

11. The apparatus of claim 1 wherein said confinement tank has a low point sump and purge valve for debris removal.

12. The apparatus of claim 1 wherein said shroud has at least one cleaning fluid clean-up jet arranged to project cleaning fluid about the inner periphery of said shroud, said jet provided with plumbing to said cleaning fluid source.

13. The apparatus of claim 12 wherein said clean-up jet has plumbing controls to, selectively, provide compressed air to replace cleaning fluid to said cleanup jet.

14. The apparatus of claim 1 wherein said brush rotates about an axis generally coincident with the pipe centerline, said brush having an extension to extend into the bore of said pipe, a mandrel bearingly supported on said extension an arranged to generally fit said bore to align and support said head on said pipe.

15. The apparatus of claim 1 wherein a centrifuge is situated to receive fluid from said confinement tank and extract a preselected lighter fraction of fluids therefrom and inject said lighter fraction into said cleaning fluid tank.

16. Thread cleaning apparatus for cleaning the threads on the end of tubular goods, positioned vertically or horizontally, at petroleum related sites, the apparatus comprising:

(a) at least one cleaning head to slip on the end of pipe;

(b) a cleaning fluid tank with valve means and plumbing for controllable delivery of cleaning fluid to said head;

(c) an effluent receiving tank with valve means and plumbing to deliver effluent fluids from said head to said receiving tank;

(d) suction means arranged to propel effluent from said head to said receiving tank;

(e) pressure means to propel said cleaning fluid from said cleaning fluid tank to said head;

said head comprising a splash confining shroud to contain threads to be cleaned, a gasket to close the opening between said shroud and the outer surface of said pipe, a motor mounted on said shroud to rotate at least one thread cleaning brush in contact with the threads on said pipe, the thread cleaning brush mounted on an output shaft of said motor, at least one nozzle arranged to receive said cleaning fluid and direct said cleaning fluid toward said threads; an extension on said brush to extend into the bore of said pipe; a gasket on said extension arranged to close the opening between said extension and the pipe bore wall to prevent escape of said cleaning fluid along said bore; and an opening in said shroud in communication with said plumbing to said receiving tank.

17. The apparatus of claim 16 wherein said cleaning fluid is directed at said threads from at least one jet attached to and rotating with said brush, said cleaning fluid being supplied from said cleaning fluid tank through a swivel attached to said head.

18. The apparatus of claim 16 wherein air is provided to selectively replace said cleaning fluid supplied to said nozzle.

19. The apparatus of claim 16 wherein said means to propel effluent comprises a compressed air jet eduction coupled vacuum pump.

20. The apparatus of claim 16 wherein a centrifuge is situated to receive effluent fluids from said confinement tank, remove a preselected lighter fraction of said effluent fluids and return said lighter fraction to said cleaning fluid tank.

* * * * *